United States Patent [19]

Harrington

[11] Patent Number: 4,706,757

[45] Date of Patent: Nov. 17, 1987

[54] WELLHEAD SUPPORTED SUBSEA TEMPLATES AND METHODS

[75] Inventor: John P. Harrington, Houston, Tex.

[73] Assignee: Amoco Corporation, Chicago, Ill.

[21] Appl. No.: 896,555

[22] Filed: Aug. 13, 1986

Related U.S. Application Data

[63] Continuation of Ser. No. 736,597, May 21, 1985, abandoned.

[51] Int. Cl.[4] ..... E21B 33/038

[52] U.S. Cl. ..... 166/349; 166/366; 175/7; 285/315; 285/382; 405/227

[58] Field of Search ..... 166/338, 342, 349, 358, 166/360, 366, 368, 344, 345, 341, 359; 175/7, 5; 285/18, 24, 27, 39, 315, 330, 382, 382.7, 920, 320, 307, 322; 405/224, 227

[56] References Cited

U.S. PATENT DOCUMENTS

| | | | |
|---|---|---|---|
| 1,507,991 | 9/1924 | Edwards | 285/330 |
| 3,239,248 | 3/1966 | Jones | 285/18 |
| 3,240,520 | 3/1966 | Dailey et al. | 285/86 |
| 3,321,015 | 5/1967 | Word, Jr. | 166/342 |
| 3,559,754 | 2/1971 | Morrill | 175/7 |
| 3,602,531 | 8/1971 | Patry | 285/382 X |
| 3,618,661 | 11/1971 | Peterman | 175/7 |
| 3,934,658 | 1/1976 | Nelson | 175/7 |
| 4,180,349 | 12/1979 | van Bilderbeek | 405/224 |
| 4,387,771 | 6/1983 | Jones | 166/341 |
| 4,497,592 | 2/1985 | Lawson | 405/202 |

OTHER PUBLICATIONS

"Offshore Construction—Drillship Sets Three-Well Template", in the Mar. 1978, issue of Ocean Industry Magazine, pp. 51 and 54.

*Primary Examiner*—James A. Leppink
*Assistant Examiner*—Hoang C. Dang
*Attorney, Agent, or Firm*—Scott H. Brown; Fred E. Hook

[57] ABSTRACT

Wellhead supported subsea template apparatus and methods of installing such template apparatus are provided. The template apparatus are each comprised of a central support member adapted to be positioned into engagement with an upper portion of an existing wellhead and to be supported thereon above the sea floor. Attached to the template are a plurality of laterally spaced guide slot members, mechanisms for removably connecting the central support member to a running tool, and mechanisms for preventing the support member from rotating on the wellhead after being positioned thereon.

12 Claims, 9 Drawing Figures

WELLHEAD SUPPORTED SUBSEA TEMPLATES AND METHODS

This is a continuation of application Ser. No. 736,597, filed May 21, 1985, now abandoned.

BACKGROUND OF THE INVENTION

1. Field of the Invention

This invention relates to sea floor template apparatus for use in the drilling of wellbores from offshore drilling structures, such as ships and platforms, and more particularly to wellhead supported subsea templates and methods of installing such templates.

2. Setting of the Invention

In offshore drilling of oil and gas wells it is advantageous to locate a plurality of wellbores close together and in a known orientation. As a result, a variety of subsea templates have been developed and used for fixing the orientation of wellbores, and for guiding the drill strings and production conduits and tools therein. Such templates include a plurality of laterally spaced guide slots which establish the horizontal location of wellbores to be drilled and are thereafter used to receive and guide the conduits and tools utilized. Certain of the known templates are placed directly on the sea floor and rely on their great mass to maintain themselves in position. A problem encountered in using these types of templates is that the templates have often become fully or partially submerged in mud or they have settled unevenly as a result of ocean floor erosion. The submerging or uneven settling of the templates has often resulted in inhibiting the passage of drill pipe, other conduits, and apparatus through the guide slots of the template and has required the carrying out of expensive remedial operations. Such sea floor supported templates are also subject to rotation after placement by action of strong currents which causes the orientation of the guide slots of the templates to be changed and other difficulties.

Other types of templates are supported by or are rigidly attached to pilings driven into the sea floor. While these templates do not encounter the problems of submerging, uneven settling, or rotation as the previously described templates, these pile-supported templates require the time-consuming and expensive pile driving procedure.

A subsea template which is supported above the sea floor by a single piling is disclosed in U.S. Pat. No. 3,618,661 issued on Nov. 9, 1971. Such template, compared to other piled templates, however, still requires the installation of a piling in the sea floor.

A more fundamental disadvantage to using templates that rest on the sea floor or are pile supported is that these templates are installed *prior* to drilling a wellbore. In other words, the drilling of a wellbore to produce oil and/or gas must be accomplished after the template is in place. If insufficient oil and/or gas are found, then no further wells will be drilled and the template is either recovered or abandoned. There is a need for a template which is installed *after* one wellbore has been drilled and the decision has already been made to drill additional wellbores adjacent thereto.

An example of a template that is connected to an existing wellhead is described in an article entitled "Offshore Construction—Drillship Sets Three-Well Template" which appears in the March 1978 issue of *Ocean Industry Magazine* at page 51. While such a template apparatus avoids the necessity of installing one or more pilings, because it rests on the sea floor, it is still subject to undesirable setting and rotation. Further, it requires that a diver attach the template by means of a gate or clamp to the existing wellhead. There is a need for a subsea template that engages to an existing wellhead and is supported above the sea floor. Further, there is a need for such a template that does not require the use of divers to install.

SUMMARY OF THE INVENTION

The present invention has been developed to overcome the foregoing deficiencies and meet the above-mentioned needs. The present invention comprises a wellhead supported subsea template for use in drilling wellbores which includes a central support member adapted for engagement with an existing wellhead and to be supported thereon above the sea floor. A plurality of spaced apart guide slots are attached to the central support member. The central support member can include a device for preventing its rotation on the wellhead. The device for preventing rotation can comprise at least one blade member attached to the central support member and positioned to be engaged by splines extending from the wellhead. Another alternate embodiment of the devices for preventing rotation comprises a clamp attached to the central support member and is adapted to be positioned over an upper portion of the wellhead and be forcibly clamped thereto.

DETAILED DESCRIPTION OF PREFERRED EMBODIMENTS

The present invention provides a wellhead supported subsea template for use in drilling wellbores. The subsea template comprises a central member adapted for engagement with a wellhead and to be supported thereon above the sea floor, and a plurality of spaced apart guide slots attached to the central support member. The subsea template can include means for preventing the central support member from rotating on the wellhead, such as blade members, splines and a clamping mechanism, as will be described in detail below.

Figure 1:
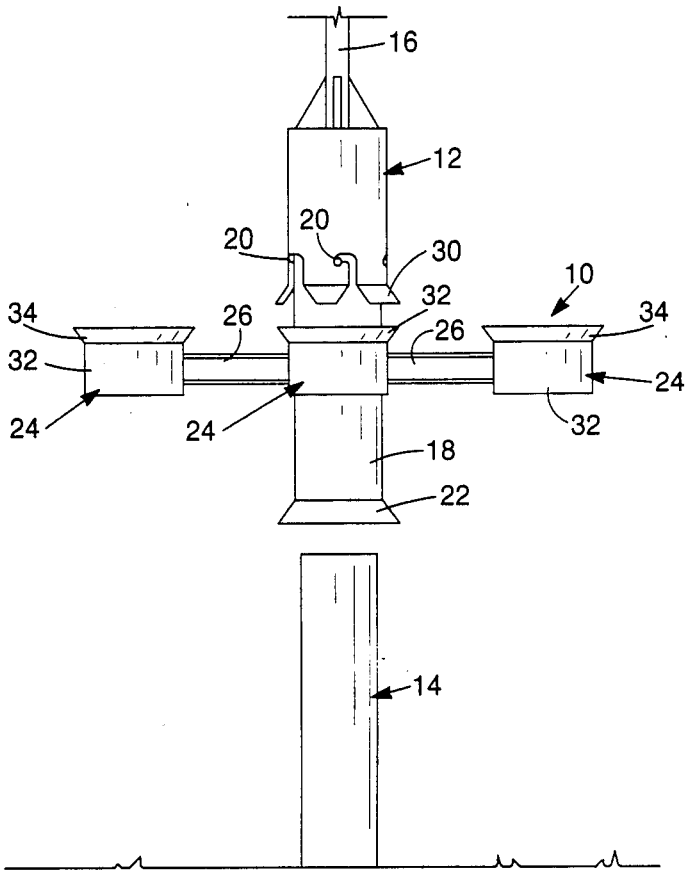
FIG. 1 is a side elevational view of a subsea wellhead and a subsea template of this invention connected to a running tool positioned for landing on the wellhead.
Figure 2:
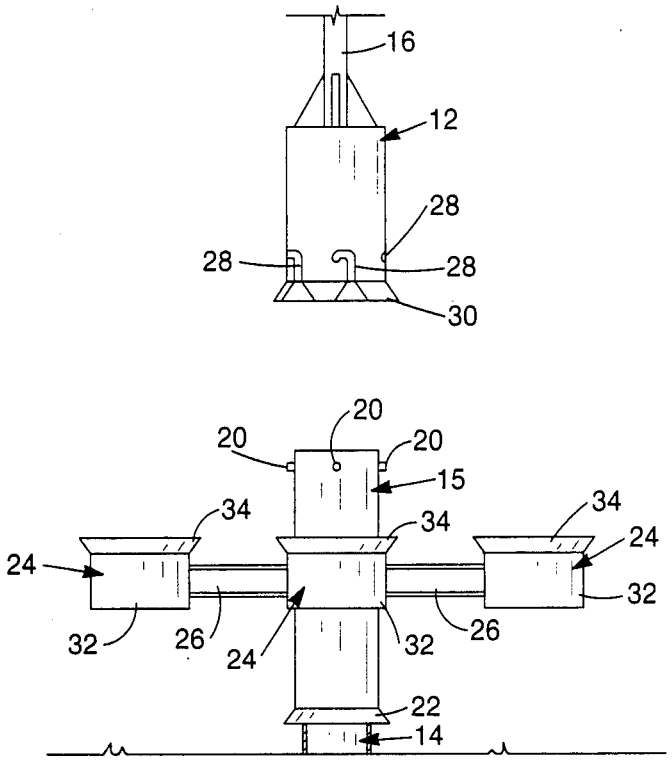
FIG. 2 is a side elevational view similar to FIG. 1 but illustrating the subsea template after it has been landed on the wellhead and the running tool disconnected therefrom.
Figure 3:
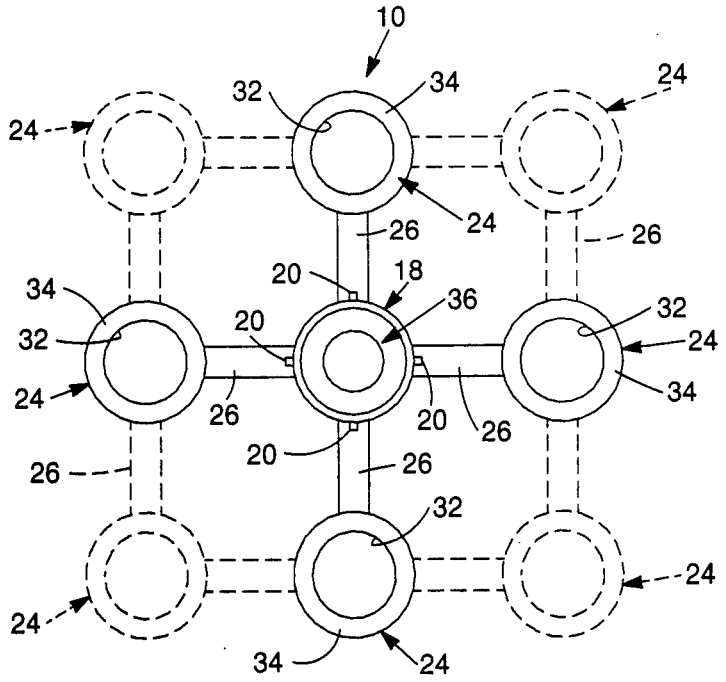
FIG. 3 is a top plan view of the subsea template of FIGS. 1 and 2.

Referring now to the drawings and particularly to FIGS. 1-3, a subsea template of the present invention is illustrated and generally designated by the reference numeral 10. The subsea template 10 is shown removably connected to a running tool 12, as is well known in the art, and positioned above a subsea wellhead 14 (prior to landing the subsea template on the wellhead 14). The running tool 12 is shown connected to a drill pipe section 16 which is in turn connected to a string of drill pipe suspended from a floating platform or the like (not shown).

The subsea template 10 includes a cylindrical central support member 18, a top portion of which includes a means for removable connection to the running tool 12, such as a plurality of lifting dogs 20. The central support member 18 is of a configuration to fit coaxially over an upper portion of the wellhead 14. An outwardly flared guide skirt 22 is attached to the bottom end of the central support member 81. As shown in FIG. 3, a plurality of laterally spaced cylindrical guide slot members 24 are connected to the central support member 18 by horizontally positioned arms 26.

One embodiment of a running tool 12 used to install the subsea template 10 includes a plurality of J-slots 28 for removably engaging the lifting dogs 20 of the central support member 18. The running tool 12 is cylindrical and is of a configuration to fit over an upper portion of the central support member 18. The running tool 12 can also include an outwardly flared guide skirt 30 attached to the bottom end thereof.

As illustrated in FIG. 2, the subsea template 10 is landed on the upwardly extending wellhead 14 by coaxially positioning the central support member 18 of the subsea template 10 over the upper portion of the wellhead 14 whereby the subsea template 10 is supported by the wellhead 14 above the sea floor. That is, the central support member 18 is of an internal size such that it engages an upper portion of the wellhead 14 and is prevented from tilting thereon. After the subsea template 10 has been landed on the wellhead 14, the running tool 12 is removed therefrom, as shown in FIG. 2, by moving the running tool 12 (relative to the central support member 18 of the subsea template 10) first downwardly then in a clockwise rotation and finally upwardly.

Referring specifically to FIG. 3, the subsea template 10 includes four guide slot members 24 which are laterally spaced from and connected to the central support member 18 by four arms 26, which can be formed of I-beam sections. The guide slot members 24 are preferably positioned symmetrically around the central support member 18; i.e., such as at 90° intervals therearound, whereby the template 10 is balanced when supported on a wellhead 14. While the guide slots 24 can take various forms, they each are preferably comprised of a vertically positioned cylindrical member 32 having an outwardly flared guide portion 34 at the top end thereof.

As will be understood by those skilled in the art, and as illustrated by dashed lines in FIG. 3, the subsea template 10 can include more or less than four laterally spaced guide slot members 24 and any desired number and arrangement of horizontal connecting arms 26 can be utilized.

Figure 4:
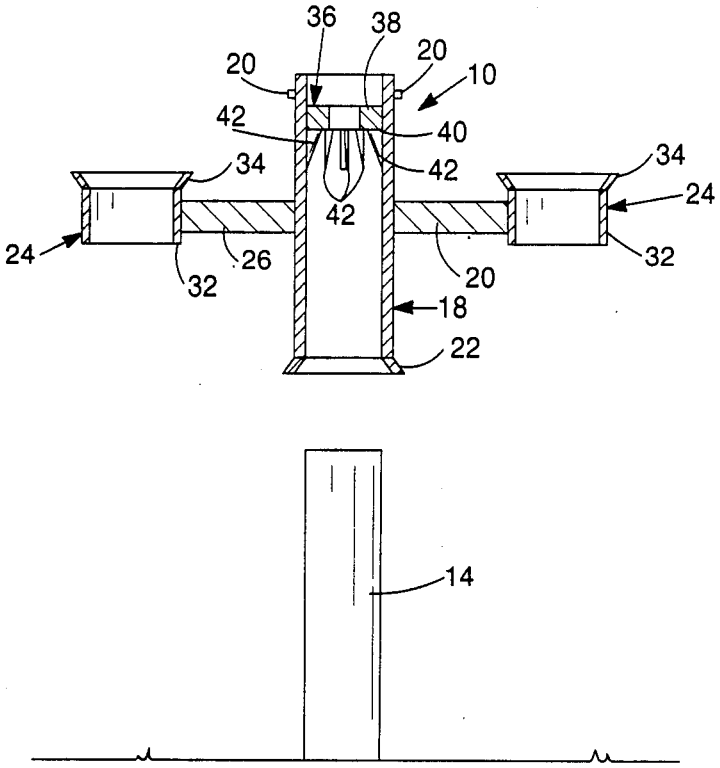
FIG. 4 is a side, partly sectional elevational view of a wellhead and an alternate embodiment of the subsea template of the present invention prior to being landed on the wellhead.
Figure 5:
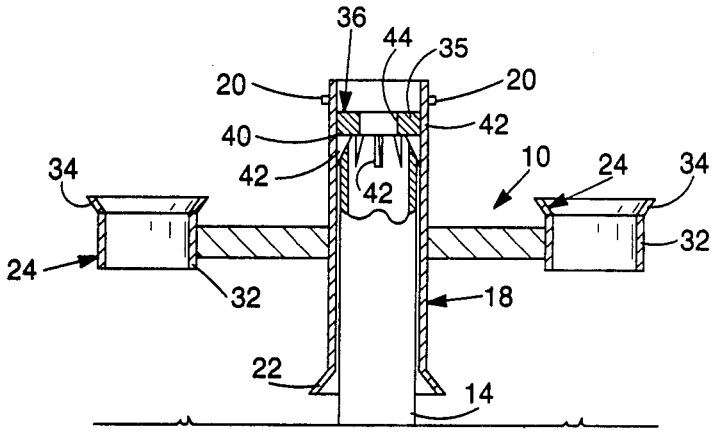
FIG. 5 is a side, partly sectional view similar to FIG. 4 but illustrating the subsea template after being landed on the wellhead.

Referring now to FIGS. 4 and 5, the subsea template 10 is shown in cross section before and after being landed on the wellhead 14. Attached within the central support member 18 of the subsea template 10 is an assembly for preventing the subsea template 10 from rotating relative to the wellhead 14 after being landed thereon and is generally designated by the numeral 36. Of the embodiment shown in FIGS. 4 and 5, the assembly 36 is comprised of an annular load support member 38 which is rigidly attached, such as by welding, within the interior of the cylindrical central support member 18, adjacent to upper portion thereof. The annular member 38 provides an inwardly extending annular shoulder 40 within the central support member 18 which contacts the top of the wellhead 14 when the subsea template 10 is landed thereon. Also rigidly attached within the central support member 18 are a plurality of inwardly facing blade members 42 positioned in spaced relationship around the internal wall surface of the central support member 18 adjacent the inwardly extending annular shoulder 40 of the member 38.

As illustrated in FIG. 5, the subsea template 10 is forced downwardly by gravity on the wellhead 14, whereby the shoulder 40 comes in contact with and is supported on the top of the wellhead 14 and the blade members 42 become embedded into the wellhead 14. The embedding of the blade members 42 in the wellhead 14 can be accomplished during the landing operation of the template apparatus 10 by including a bumper sub or drilling jar (not shown) in the drill string above the running tool 12. The bumper sub is used to jar the template apparatus 10 and thereby insure that the blade members 42 are embedded in the wellhead 14.

As will now be understood, the subsea template 10 of the present invention is maintained on the wellhead 14 and the central support member 18 is snugly fitted therover. In addition, the subsea template 10 is prevented from rotating on the wellhead 14 by the blade members 42. Once the blade members 42 are embedded into the top of the wellhead 14 and the annular shoulder 40 is seated thereon, the weight of the subsea template 10 prevents it from moving upwardly. After the subsea template 10 has been installed, additional wellbores can be drilled as guided by the respective conduits thereof passing through the guide slots 24. Also a stinger assembly (not shown) can be stabbed and seated through the opening 44 in the load member 38, as is well known in the art, to enable production of oil and/or gas through the wellhead 14. Alternately the opening 44 can be provided with threads for removable connection of a tubing (not shown) to enable the production of oil and/or gas through the wellhead 14, as is well known in the art; or conduits can pass through the opening 44 and connect with smaller diameter coaxially spaced conduits within the casing 14.

Figure 6:
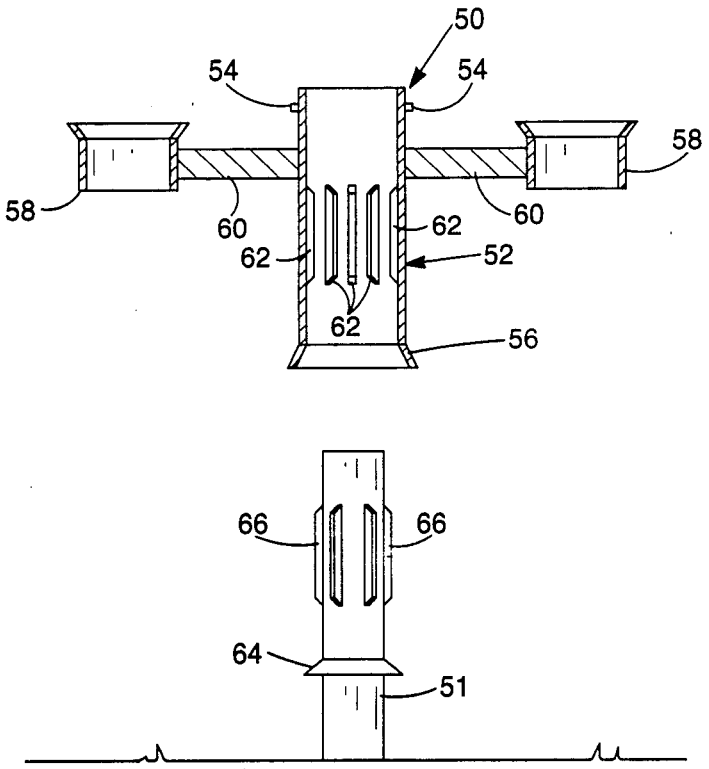
FIG. 6 is a side, partly sectional elevational view of a wellhead and an alternate embodiment of the subsea template of the present invention prior to being landed on the wellhead.
Figure 7:
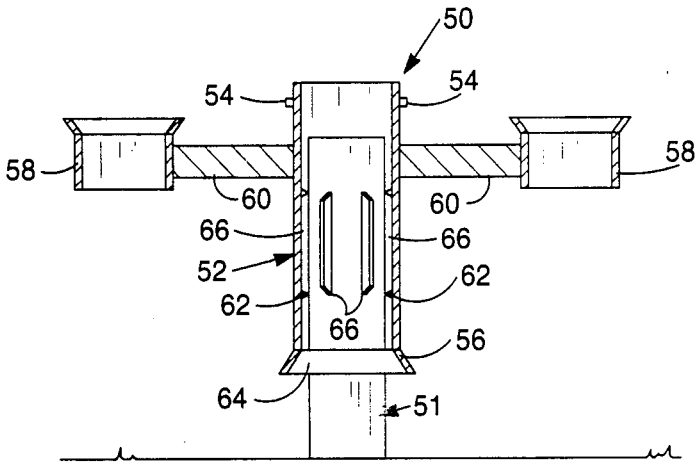
FIG. 7 is a side, partly sectional view similar to FIG. 6 illustrating the subsea template after being landed on the wellhead.

Referring now to FIGS. 6 and 7, an alternate embodiment of the subsea template is generally designated by the reference number 50 and is illustrated in cross section before and after being landed on a wellhead 51. With the exception of the means for preventing rotation of the subsea template, the subsea template 50 can be identical to the subsea template 10 described previously. That is, the subsea template 50 includes a cylindrical central support member 52 having a plurality of lifting dogs 54 attached to an upper portion thereof for engagement with a running tool, and having an outwardly flaring guide skirt 56 attached at the bottom end thereof. A plurality of laterally spaced guide slot members 58 are attached to the central support member 52 by connecting arms 60.

Attached within the central support member 52 of the subsea template 50 are a plurality of inwardly projecting vertically elongated lugs 62 which are positioned in spaced relationship around the internal wall of the member 52. The wellhead 51 includes a load bearing ring 64 rigidly attached thereto which is tapered to conform with the outwardly flared guide skirt 56 of the central support member 52. The guide skirt 56 of the support member 52 seats on the ring 64 and is supported thereby when the template apparatus 50 is landed on the wellhead 51.

In addition the load support ring 64, the wellhead 51 includes a plurality of vertically orientated splines 66 attached thereto and positioned in spaced relationship therearound. The splines 66 are of a size and are spaced such that when the subsea template 50 is seated on the wellhead 51, as illustrated in FIG. 7, each of the lugs 62 are positioned between a pair of the splines 66 and rotation of the template apparatus 50 relative to the wellhead 51 is prevented thereby.

Figure 8:
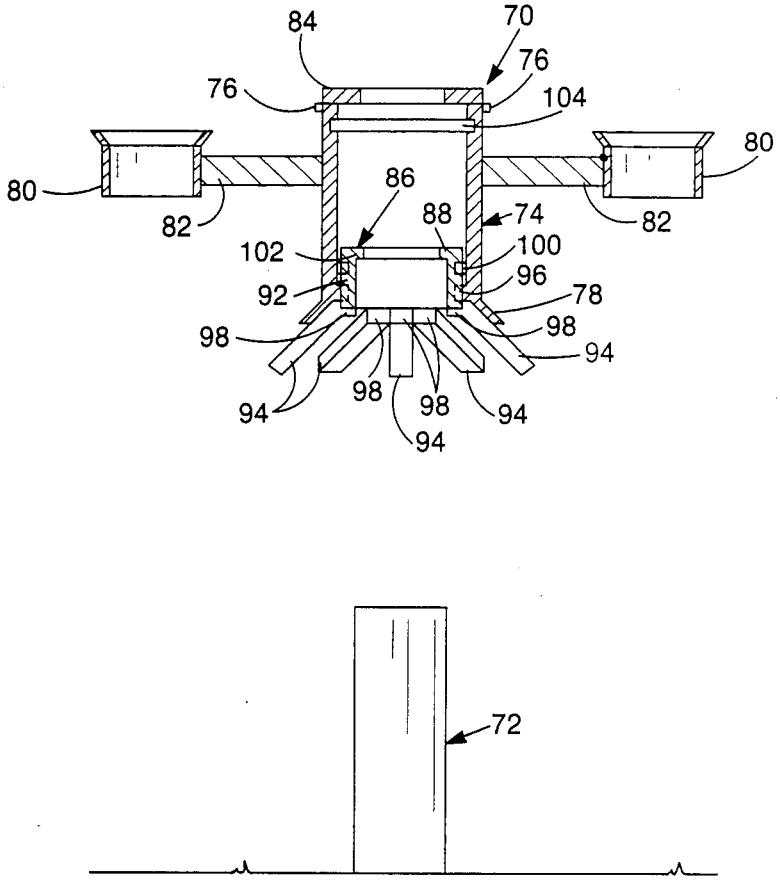
FIG. 8 is a side, partly sectional elevational view of a wellhead and another alternate embodiment of the subsea template of the present invention prior to the subsea template being landed on the wellhead.
Figure 9:
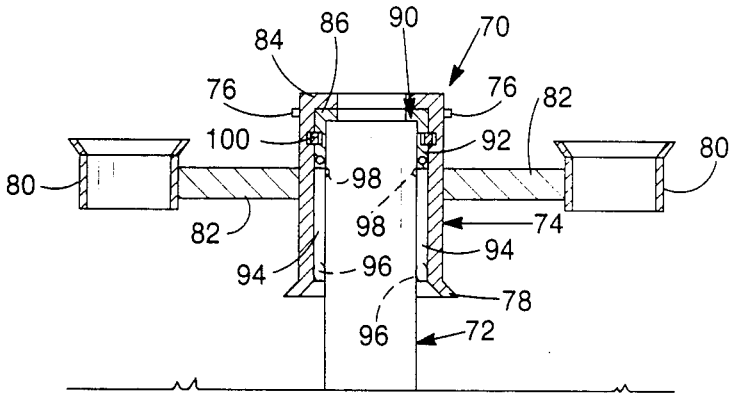
FIG. 9 is a side, partly sectional view similar to FIG. 8 illustrating the subsea template after being landed on the wellhead.

Referring now to FIGS. 8 and 9, another embodiment of the subsea template of the present invention, generally designated by the reference numeral 70, is illustrated in cross section before and after being landed on a wellhead 72. Like the subsea templates 10 and 50, the subsea template 70 is comprised of a cylindrical central support member 74 having a plurality of lifting dogs 76 attached to an upper portion thereof for removably engaging a running tool. An outwardly flared guide skirt 78 is attached to the bottom end of the support member 74. A plurality of laterally spaced guide slot members 80 are attached to the support member 74 by a plurality of arm members 82, and an inwardly extending load support ring 84 is attached is the support member 74 at the top thereof.

A spider clamp assembly, generally designated by the numeral 90, is disposed within the central support member 74. The clamp assembly 90 is comprised of a cylindrical body member 92 having an inwardly extending load support ring 86 attached at the top thereof and a plurality of outwardly biased tongs 94 pivotally attached at the bottom thereof. The body member 92 of the spider clamp 90 is slidably disposed within the center support member 74 whereby it is free to move longitudinally therein, but is prevented from rotating therein. That is, the body member 92 includes one or more longitudinal guide slots (not shown) formed therein in alignment with spaces between the tongs 94 which engage one or more lugs 96 attached within the lower portion of the central support member 74. As illustrated in FIG. 8, prior to landing the subsea template 70 on the wellhead 72, the spider clamp 90 is supported within the lower end portion of the central support member 74 by the lugs 96 with each of the tongs 94 held in an outwardly extended position beneath the central support member 74.

Each of the tongs 94 of the clamp assembly 90 includes an enlarged die portion 98 at an upper portion thereof for engaging the wellhead 72. A locking ring 100 can be disposed in a retaining groove 102 formed in the exterior of the body member 92 adjacent the top thereof. A locking ring retaining groove 104 complementary to the groove 102 in the body member 92 is disposed in the interior of the support member 74 near the top end thereof.

When the template apparatus 70 is landed on the wellhead 72, the top portion of the wellhead 72 extends within the interior of the body member 92 of the spider clamp 90 and the body member 92 is supported thereon by the support ring 86 attached to the body member 92. As the template apparatus 70 is moved downwardly, the central support member 74 is moved downwardly relative to the spider clamp 90 and the wellhead 72 causing the body member 92 of the spider clamp to be moved within the support member 74 into contact with the load support ring 84 thereof. Simultaneously, the tongs 94 are pivoted inwardly by the support member 74 whereby the dies 98 thereof engage the wellhead 72. As shown in FIG. 9, when the template apparatus 70 is fully lowered on the wellhead 72 and the spider clamp 90 is moved to the top of the support member 74, the locking ring 100 (if included with the apparatus) snaps into the complementary groove 104 in the support member 74 thereby locking the support member and body member 92 of the spider clamp 90 together and preventing the upward movement of the subsea template 70 relative to the wellhead 72. The dies 98 of the tongs 96 bite into the wellhead 72 thereby rigidly attaching the subsea template 70 to the wellhead 72 and preventing the subsea template 70 from rotating relative to the wellhead 72.

Each of the various embodiments of the subsea template of this invention can be installed on a wellhead located below the surface of a body of water in accordance with the present invention by lowering the template through the water on the end of a running tool, by divers (if a lightweight template is used and supported by buoyancy means), or by submersible vehicle, and positioning the subsea template on the wellhead. The subsea template is supported on the wellhead adjacent to but above the floor of the body of water. The subsea template is caused to engage the wellhead whereby it is prevented from rotating relative to the wellhead. The subsea template can be installed on and removed from a wellhead remotely by means of a removable running tool and can be connected to the wellhead whereby it will not readily move upwardly relative thereto.

Thus the present invention is well adapted to attain the objects and advantages mentioned, as well as those inherent therein. While presently preferred embodiments of the invention have been described herein for the purpose of disclosure, numerous changes in the construction and arrangement of parts will suggest themselves to those skilled in the art, which changes are encompassed within the spirit of this invention as defined by the appended claims.

What is claimed is:

1. A wellhead supported subsea template for use in drilling wellbores, comprising:

a central support member for engagement on a wellhead above the sea floor;

a plurality of spaced apart guide slots attached to the central support member; and at least one blade member attached to said central support member and positioned to cut into said wellhead when said central support member is engaged therewith for preventing said central support member from rotating on said wellhead.

2. The wellhead supported subsea template of claim 1 wherein said central support member is cylindrical and includes an inwardly extending annular shoulder for contacting said wellhead and supporting said support member thereon.

3. The wellhead supported subsea template of claim 2 wherein said central support member includes an outwardly flared guide skirt at the bottom end portion thereof.

4. A method of installing a wellhead supported subsea template adjacent to the floor of a body of water, comprising the steps of:

positioning said template on an existing wellhead whereby said template is supported thereby adjacent to and above the floor of said body of water; and causing said template to engage said wellhead so that said template is prevented from rotating relative to said wellhead by embedding at least one blade member attached within a central support member of said template into an upper portion of said wellhead when said central support member is contacted therewith.

5. The method of claim 4 wherein the step of positioning said template includes:

removably attaching a running tool to said template; and lowering said running tool and template to said wellhead.

6. The method of claim 5 wherein the step of positioning said template further includes:

positioning a central support member of said template over an upper portion of said wellhead whereby said template is supported and maintained by said wellhead; and removing said running tool from said template.

7. A wellhead supported subsea template for use in drilling wellbores, comprising:

a central support member having a central bore extending therethrough for supported engagement on a wellhead above the sea floor;

a plurality of spaced apart guide slots attached to said central support member; and a plurality of tongs pivotally attached to an inner sleeve slidely disposed within said central bore of said central support member to prevent the rotation of said central support member on said wellhead.

8. The wellhead supported subsea template of claim 7 wherein said central support member is cylindrical and includes an inwardly extending annular shoulder for contacting said wellhead and supporting said support member thereon.

9. The wellhead supported subsea template of claim 7 wherein said central support member includes an outwardly flared guide skirt at the bottom end portion thereof.

10. A method of installing a wellhead supported subsea template having a central support member adjacent to the floor of a body of water, comprising the steps of:

positioning said template on an existing wellhead whereby said template is supported thereby adjacent to and above the floor of said body of water; and lowering said template onto said wellhead and slidably moving an inner sleeve upwardly within a central bore of said central support member thereby causing a plurality of engagement tongs pivotally mounted to said inner sleeve to close about the outer surface of said wellhead.

11. The method of claim 10 wherein the step of positioning said template includes:

removably attaching a running tool to said template; and lowering said running tool and template to said wellhead.

12. The method of claim 11 wherein the step of positioning said template further includes:

positioning a central support member of said template over an upper portion of said wellhead whereby said template is supported and maintained by said wellhead; and removing said running tool from said template.

* * * * *